US006648686B2

(12) United States Patent
Nishimoto

(10) Patent No.: US 6,648,686 B2
(45) Date of Patent: Nov. 18, 2003

(54) ELECTRICAL CONNECTOR

(75) Inventor: Naohiro Nishimoto, Hashimoto (JP)

(73) Assignee: Shimano Inc., Osaka (JP)

( * ) Notice: Subject to any disclaimer, the term of this patent is extended or adjusted under 35 U.S.C. 154(b) by 0 days.

(21) Appl. No.: 09/725,459

(22) Filed: Nov. 30, 2000

(65) Prior Publication Data

US 2002/0064995 A1 May 30, 2002

(51) Int. Cl.[7] ..... H01R 13/58
(52) U.S. Cl. ..... 439/606; 439/605
(58) Field of Search ..... 439/606, 455, 439/278, 279, 588, 589, 604, 605, 877, 857, 866, 865

(56) References Cited

U.S. PATENT DOCUMENTS

| | | | | | |
|---|---|---|---|---|---|
| 3,248,686 | A | * | 4/1966 | Ruehlemann | 339/213 |
| 3,536,869 | A | * | 10/1970 | Renshaw et al. | 439/701 |
| 4,466,684 | A | * | 8/1984 | Grant et al. | 439/176 |
| 4,628,159 | A | * | 12/1986 | Deitch et al. | 200/51 |
| 4,767,356 | A | * | 8/1988 | Grappe | 439/455 |
| 4,874,325 | A | * | 10/1989 | Bensing et al. | 439/272 |
| 5,131,874 | A | | 7/1992 | Seido | |
| 5,603,638 | A | * | 2/1997 | Brown et al. | 439/606 |
| 5,993,256 | A | * | 11/1999 | Shimojyo | 439/604 |

FOREIGN PATENT DOCUMENTS

| | | |
|---|---|---|
| EP | 0 147 332 | 7/1985 |
| JP | 45-5575 | 3/1970 |
| JP | 56-43987 | 10/1981 |
| JP | 61-99376 | 6/1986 |
| JP | 62-24485 | 2/1987 |
| JP | 62-20146 | 5/1987 |
| JP | 62-136783 | 6/1987 |
| JP | 62-173187 | 11/1987 |
| JP | 1-77878 | 12/1989 |
| JP | 2-195672 | 8/1990 |
| JP | 6-333633 | 12/1994 |
| JP | 2541481 | 4/1997 |
| JP | 9-270282 | 10/1997 |
| JP | 10-83871 | 3/1998 |

* cited by examiner

*Primary Examiner*—Alexander Gilman
(74) *Attorney, Agent, or Firm*—Shinjyu Global IP Counselors, LLP

(57) ABSTRACT

An electrical connector for wiring is disclosed that can be used outdoors such as on a bicycle. The electrical connector is electrically coupled to one end of an electrical cord. The electrical connector basically has a terminal housing, at least one terminal pin, an inner casing, and an outer casing. The terminal housing has an insulated body with a first end, a second end and at least one terminal bore longitudinally extending between the first and second ends. Preferably, the terminal housing has a plurality of terminal bores with one of the terminal pins being retained within each one of the terminal bores of the terminal housing. Each terminal bore has a first bore section with a cross-section formed by an intersection of a rectangle and a circle. Each terminal pin has a first contact end and a second connection end with a bent portion forming a cord receiving recess located on a first longitudinal side of the second connection end such that the cord receiving recess lies within a main plane of the second connection end. The electrical cord has an electrical conductor fixedly coupled to each terminal pin to form an electrical connection therebetween. The inner casing has a tubular side wall with the terminal housing located in a first open end of the tubular side wall and the electrical conductor located in a second open end of the tubular side wall. The tubular side wall has at least one side opening, preferably two side openings. The outer casing is molded over portions of the terminal housing and the tubular side wall of the inner casing. The outer casing is molded such that the material extends into the side opening of the tubular side wall of the inner casing.

30 Claims, 7 Drawing Sheets

ELECTRICAL CONNECTOR

BACKGROUND OF THE INVENTION

1. Field of the Invention

This invention generally relates to an electrical connector. More specifically, the present invention relates an electrical connector that provides improved durability and waterproofing as well as an improved electrical connection.

2. Background Information

Bicycling is becoming an increasingly more popular form of recreation as well as a means of transportation. Moreover, bicycling has also become a very popular competitive sport for both amateurs and professionals. Whether the bicycle is used for recreation, transportation or competition, the bicycle industry is constantly improving the various components of the bicycle. The drive train of the bicycle has been redesigned over the past years. Specifically, manufacturers of bicycle components have been continually improving shifting performance of the various shifting components such as the shifter, the shift cable, the derailleur, the chain and the sprocket.

Recently, bicycles have been provided with an electronic drive train for smoother shifting. These electronic drive trains include a rear multi-stage sprocket assembly with a motorized rear derailleur and a front multi-stage sprocket assembly with a motorized front derailleur. These derailleurs are electronically operated by a cycle computer for automatically and/or manually shifting of the derailleurs. The cycle computer is also often coupled to other components that are electrically controlled or operated. In this type of an arrangement, electrical wires or cords are utilized to transmit the electrical current to and from the various components. These electrical wires are often connected to the components by electrical connectors. Since the bicycle is typically utilized outdoors, the electrical connections of the electrical connectors are exposed to a variety of weather conditions. The electrical connections can often be contaminated so as to degrade performance of the shifting and/or operation of the electrical control component. If the electrical connections get too dirty, the bicycle will not properly shift. Moreover, since the electrical connections are exposed to adverse weather conditions, it is important that the electrical connectors provide a good solid connection so that they can operate even though they may become slightly contaminated.

In view of the above, there exists a need for an electrical connector that provides improved durability and waterproofing as well as an improved electrical connection and which overcomes the above mentioned problems in the prior art. This invention addresses this need in the prior art as well as other needs, which will become apparent to those skilled in the art from this disclosure.

SUMMARY OF THE INVENTION

One object of the present invention is to provide an electrical connector that provides improved durability and waterproofing.

Another object of the present invention is to provide an electrical connector an improved electrical connection.

The foregoing objects can be attained by providing an electrical connector that is electrically coupled to one end of an electrical cord. The electrical connector basically has a terminal housing, at least one terminal pin, an inner casing, and an outer casing. The terminal housing has a first end and a second end with at least one terminal bore longitudinally extending between the first and second ends. Preferably, the terminal housing has a plurality of terminal bores with one of the terminal pins being retained within each one of the terminal bores of the terminal housing. Each terminal bore has a first bore section with a cross-section formed by an intersection of a rectangular portion and a circular portion. The circular portion of the cross-section of the first bore section has a diameter that is larger than a width of the rectangular portion of the cross-section of the first bore section such that the circular portion of the cross-section of the first bore section extends outwardly from a pair of sides of the rectangular portion of the cross-section of the first bore section. Each terminal pin has a first contact end and a second connection end with a bent portion forming a cord receiving recess located on a first longitudinal side of the second connection end such that the cord receiving recess lies within a main plane of the second connection end. The electrical cord has an electrical conductor fixedly coupled to each terminal pin to form an electrical connection therebetween. The inner casing has a tubular side wall with the terminal housing located in a first open end of the tubular side wall and the electrical conductor located in a second open end of the tubular side wall. The tubular side wall has at least one side opening, preferably two side openings. The outer casing is molded over portions of the terminal housing and the tubular side wall of the inner casing. The outer casing is molded such that the material extends into the side opening of the tubular side wall of the inner casing.

In accordance with another aspect of the present invention, an electrical terminal housing comprising an insulated body including a first end, a second end and a terminal bore extending longitudinally between the first and second ends, the terminal bore having a first bore section with a cross-section formed by an intersection of a rectangular portion and a circular portion. The first bore section extends from the first end. The circular portion of the cross-section of the first bore section has a diameter that is larger than a width of the rectangular portion of the cross-section of the first bore section such that the circular portion of the cross-section of the first bore section extends outwardly from a pair of sides of the rectangular portion of the cross-section of the first bore section.

In accordance with yet another aspect of the present invention an electrical terminal pin comprising a first end; and a second end having a bent portion forming a cord receiving recess located on a first longitudinal side of the second end such that the cord receiving recess lies within a main plane of the second end.

These and other objects, features, aspects and advantages of the present invention will become apparent to those skilled in the art from the following detailed description, which, taken in conjunction with the annexed drawings, discloses a preferred embodiment of the present invention.

BRIEF DESCRIPTION OF THE DRAWINGS

Referring now to the attached drawings which form a part of this original disclosure.

DETAILED DESCRIPTION OF THE PREFERRED EMBODIMENTS

Referring initially to FIGS. 1A–1C, 2 and 3, a bicycle 10 is illustrated with an electronically controlled drive train 12 (FIGS. 1A–1C) that uses an electrical connector 14 (FIGS. 2–3) in accordance with a first embodiment of the present invention, as discussed below. Bicycle 10 and its various components are well known in the prior art, except for the electrical connector 14 of the present invention. Thus, the bicycle 10 and its various components will not be discussed or illustrated in detail herein, except for the components that relate to the present invention. Moreover, various conventional bicycle parts such as brakes, additional sprockets, etc., which are not illustrated and/or discussed in detail herein, can be used in conjunction with the present invention.

As used herein, the following directional terms "forward, rearward, upward, above, downward, vertical, horizontal, below and transverse" as well as any other similar directional terms refer to those directions of a bicycle in its normal riding position. Accordingly, these terms, as utilized to describe the present invention in the claims, should be interpreted relative to bicycle 10 in its normal riding position.

Figure 1A:
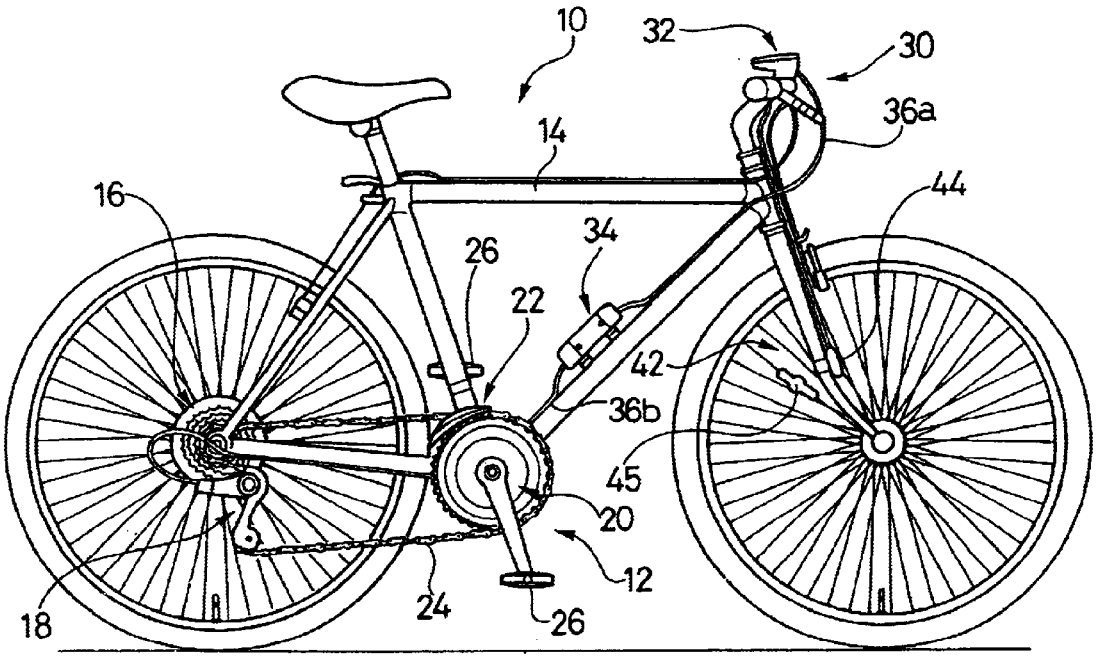
FIG. 1A is a side elevational view of a bicycle with an electronically controlled drive train that uses an electrical connector in accordance with a first embodiment of the present invention.
Figure 1B:
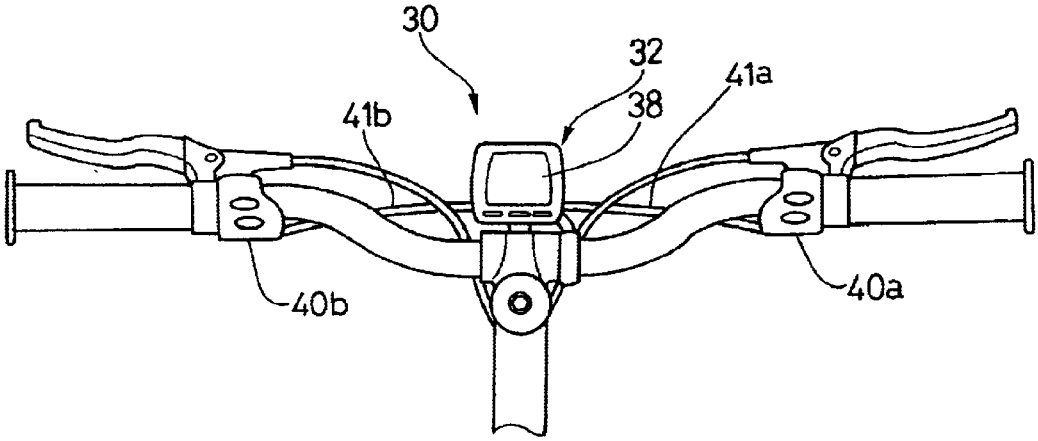
FIG. 1B is a top plan view of the handlebar portion of the bicycle with a shift control unit and a pair of shifting devices coupled thereto.
Figure 1C:
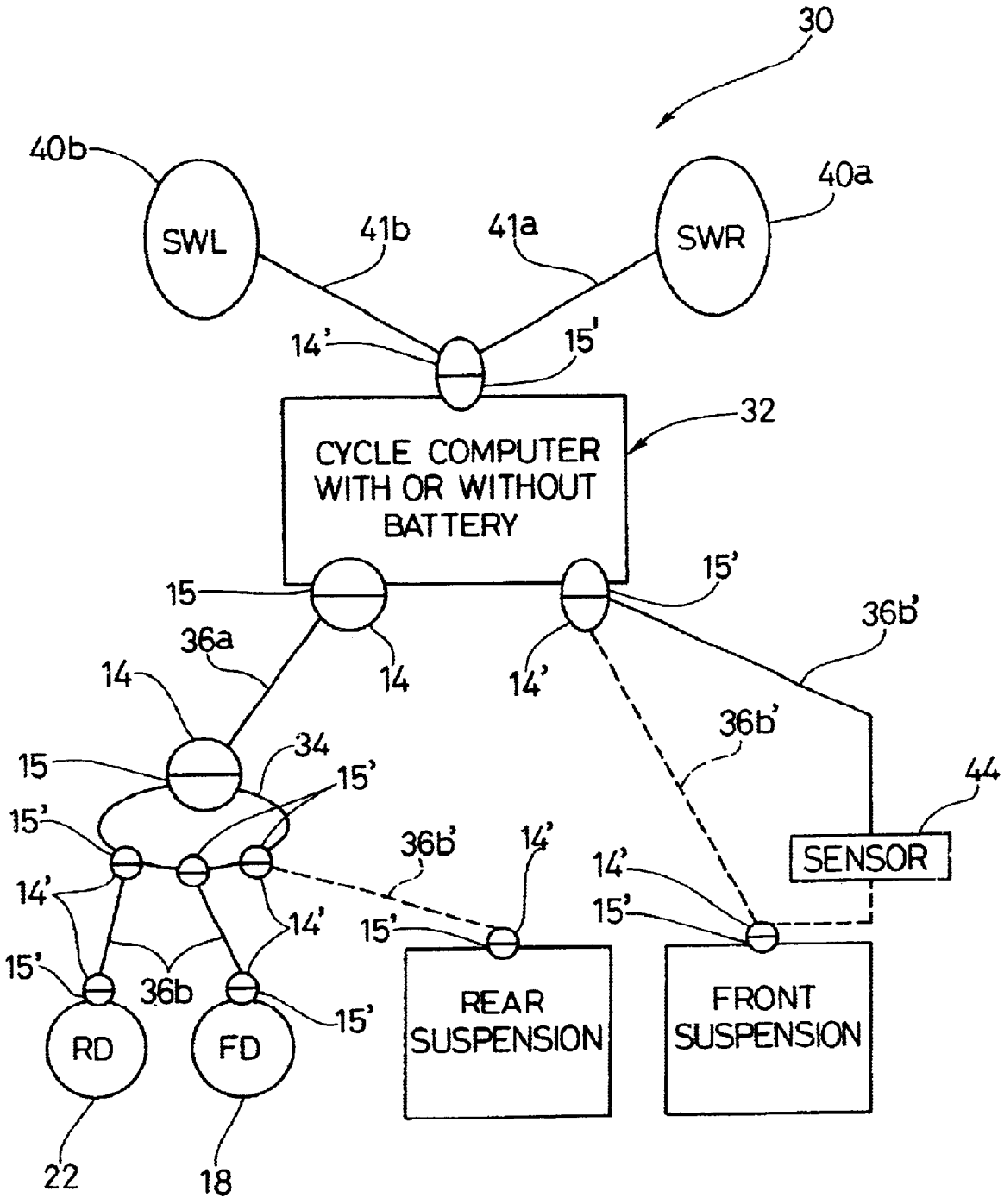
FIG. 1C is a diagrammatic illustration of the control system that uses electrical connectors of the present invention.

Referring to FIGS. 1A–1C, the drive train 12 basically includes a rear multi-stage sprocket assembly 16 with a motorized rear derailleur or chain shifting device 18, a front multi-stage sprocket assembly 20 with a motorized front derailleur or chain shifting device 22, a chain 24 extending between the rear multi-stage sprocket assembly 16 and the front multi-stage sprocket assembly 20, and a pair of pedals 26 mounted to rotate the front multi-stage sprocket assembly 20. An electronic control system 30 basically operates the drive train 12. The electronic control system 30 basically includes a shift control unit 32 with a junction box or connection unit 34. The shift control unit 32 and the junction box 34 are electrically coupled together by an electrical control cord 36*a* which in turn are electrically coupled to electrical control cords 36*b* that are electrically coupled to the motorized derailleurs 18 and 22. The shift control unit 32 is also electrically coupled to shifting devices 40*a* and 40*b* via electrical cords 41*a* and 41*b*, respectively.

As illustrated in FIG. 1C, the electronic control system 30 can also be utilized to control the front and rear suspension and/or other components of the bicycle which are not shown. In the illustrated embodiment of FIG. 1C, the electrical cord 36*a* is a fifteen-line cord in which only thirteen of the lines or conductors are utilized. More specifically, the electrical control cords 36*b* are each six-line cords with only five of the lines or conductors being utilized. The electrical control cord 36*b*' for the rear suspension is preferably a six-line cord with only two lines or conductors being utilized. In this illustrated embodiment, the electrical connectors 14 are fifteen-pin electrical connectors with only some of the pins being utilized. The electrical connectors 14' and 15' are six-pin electrical connectors with only some of the pins being utilized. In the case of the rear suspension system, the electrical connectors 14' and 15' only utilize two of the terminal pins. In the case of the front suspension system, the electrical connectors 14' and 15' utilize only four of the pins.

Of course, it will be apparent to those skilled in the art from this disclosure that these connectors 14, 14', 15 and 15' can be utilized with other bicycle components and in other types of arrangements as needed and/or desired. For example, the bicycle 10 of FIG. 1A does not have front and rear suspension systems. Therefore, these portions would not be included in the bicycle of FIG. 1A. Rather, the cycle computer or control unit 32 is connected to sensor 44 via an electrical cord 36*b*' in which only two of the conductors are utilized.

The shift control unit or cycle computer 32 preferably includes a microcomputer formed on a printed circuit board that is powered by a battery unit. The microcomputer of the shift control unit 32 includes a central processing unit (CPU), a random access memory component (RAM), a read only memory component (ROM), and an I/O interface. The various components of the microcomputer are well known in the bicycle field. Therefore, the components used in the microcomputer of the shift control unit 32 will not be discussed or illustrated in detail herein. Moreover, it will be apparent to those skilled in the art from this disclosure that the shift control unit 32 can include various electronic components, circuitry and mechanical components to carryout the present invention. Of course, it will be apparent to those skilled in the art from this disclosure that the shift control unit 32 can have a variety of configurations, as needed and/or desired.

Preferably, the shift control unit 32 is a cycle computer that provides or displays various information to the rider via a display 38 and that operates the motorized derailleurs 18 and 22. Thus, the drive train 12 of bicycle 10 is operated or electronically controlled by the shift control unit 32. More specifically, the shift control unit 32 is a cycle computer that electrically operates the motorized derailleurs 18 and 22 either automatically or manually as explained below.

One example of an automatic shifting assembly that can be utilized with the present invention is disclosed in U.S. Pat. No. 6,073,061 to Kimura, which is assigned to Shimano Inc.

In the manual mode, shifting of each of the motorized derailleurs 18 and 22 is preformed by via manual down and up shift devices 40*a* and 40*b*. While the shift devices 40*a* and 40*b* illustrated herein utilizes down and up shift buttons, it will be apparent to those skilled in the art from this disclosure that various other types of shift devices can used, such as levers, without departing from the scope of the invention as defined in the appended claims. Depressing one of the shift buttons of the shift devices 40*a* and 40*b* generates a predetermined operational command that is received by the central processing unit of the shift control unit 32. The central processing unit of the shift control unit 32 then sends a predetermined operational command or electrical signal to move or shifting one of the motorized derailleurs 18 and 22.

In the automatic mode, shifting of each of the motorized derailleurs 18 and 22 is preferably at least partially based on the speed of the bicycle. Thus, the shift control unit 32 further includes at least one sensing/measuring device or component 42 that provides information indicative of the speed of the bicycle 10 to its central processing unit of the shift control unit 32. The sensing/measuring component 42 generates a predetermined operational command indicative of the speed of the bicycle 10. Of course, additional sensing/measuring components can be operatively coupled to central processing unit of the shift control unit 32 such that predetermined operational commands are received by the central processing unit (CPU) of the shift control unit 32 to operate the motorized derailleurs 18 and 22 or other components.

The sensing/measuring component 42 can be, for example, a speed sensing unit that includes a sensor 44 and a magnet 45. The sensor 44 is preferably a magnetically operable sensor that is mounted on the front fork of the bicycle 10 and senses the magnet 45 that is attached to one of the spokes of the front wheel of the bicycle 10. The sensor 44 can be a reed switch or other component for detecting the magnet 45. Sensor 44 generates a pulse each time wheel of the bicycle 10 has turned a pre-described angle or rotation. In other words, the sensor 44 detects the rotational velocity of the front wheel of the bicycle 10. As soon as sensor 44 generates the pulse or signal, a pulse signal transmission circuit sends this pulse signal to the central processing unit of the shift control unit 32 to determine whether the chain 24 should be up shifted or down shifted. Thus, the sensor 44 and the magnet 45 form a sensing device or measuring component of the shift control unit 32. In other words, the sensor 44 outputs a bicycle speed signal by detecting a magnet 45 mounted on the front wheel of the bicycle 10. Thus, speed information is sent to the battery operated electronic shift control unit 32 to operate the motorized derailleur 18 and 22.

The junction box 34 preferably includes a single power input or electrical control cords 36*a* for receiving signals from the shift control unit 32 and a pair of power outputs or electrical control cords 36*b* for sending signals to the rear and front motorized derailleur 18 and 22. The power input operatively couples the shift control unit 32 to the junction box 34. Preferably, one power output or electrical control cord 36*b* operatively couples the rear derailleur 18 to the junction box 34 and the other power output or electrical control cord 36*b* operatively couples to the front derailleur 22 to the junction box 34. Preferably, the electrical control cords 36*a* and 36*b* use the electrical connectors, such as ones similar to the electrical connector 14 of the present invention and the mating electrical connector 15.

Figure 2:
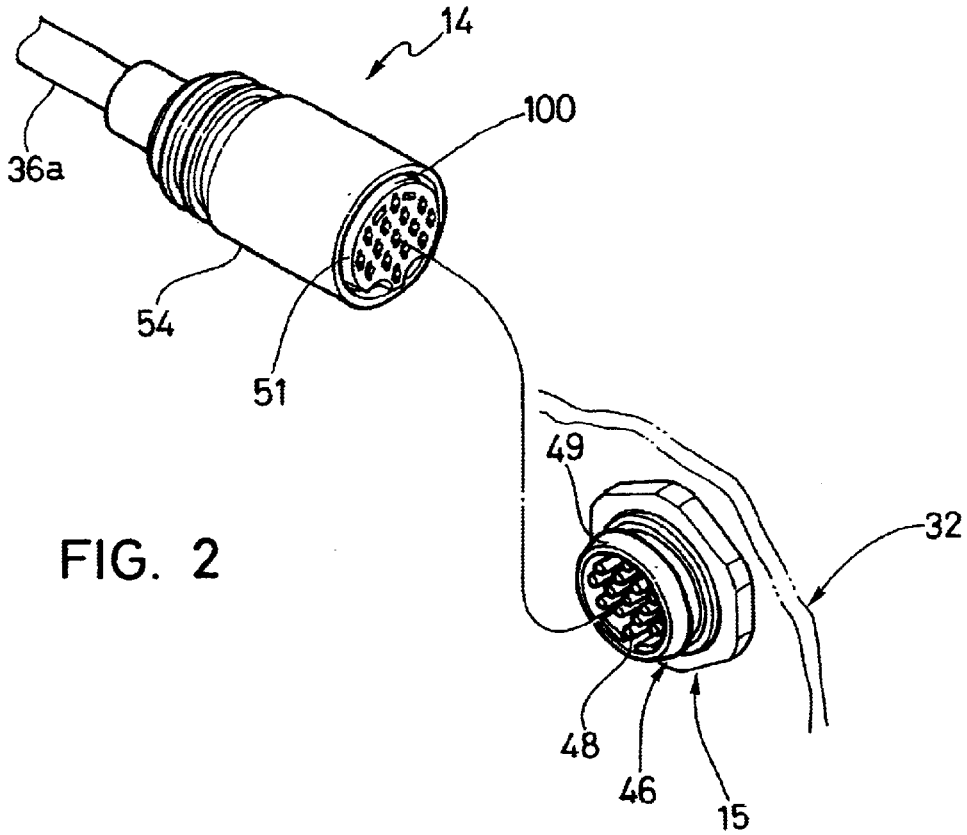
FIG. 2 is a perspective view of the male electrical connector coupled to the shift control unit and the female electrical connector of the present invention, prior to being coupled together.
Figure 3:
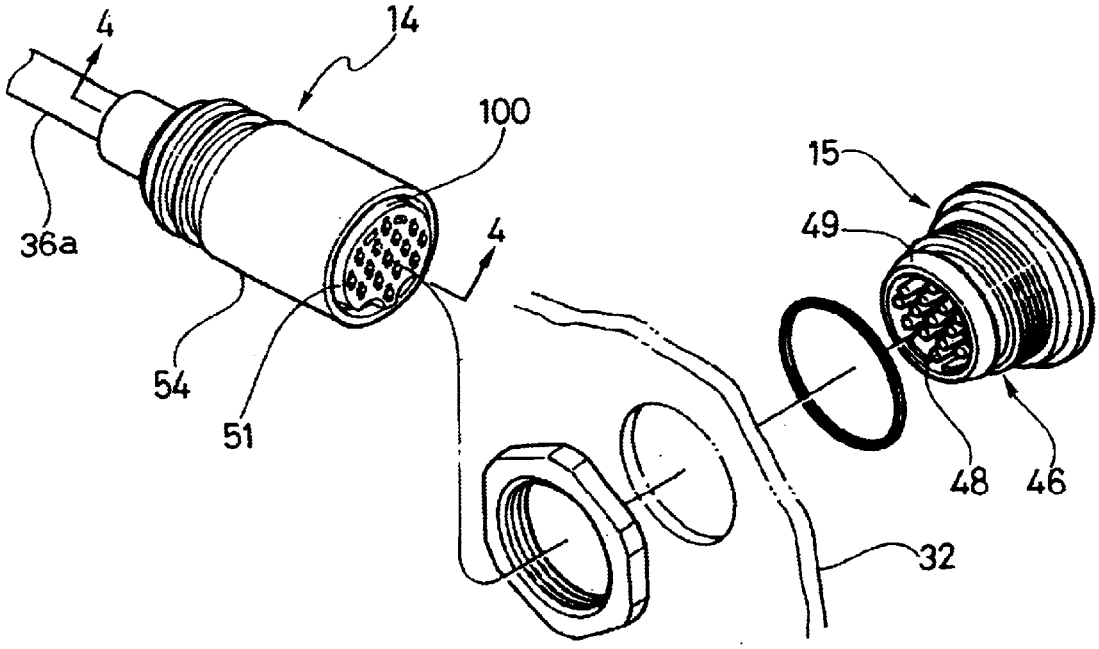
FIG. 3 is a partially exploded perspective view, similar to FIG. 2, of the male connector and the female connector in accordance with the present invention.
Figure 4:
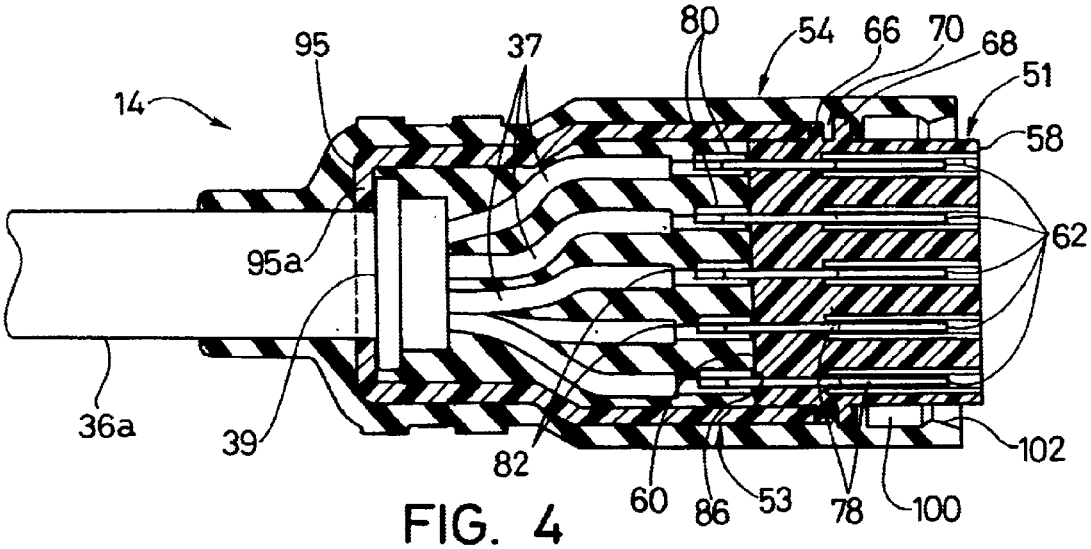
FIG. 4 is a longitudinal cross-sectional view of the female electrical connector taken along section 4—4 of FIG. 3.
Figure 5:
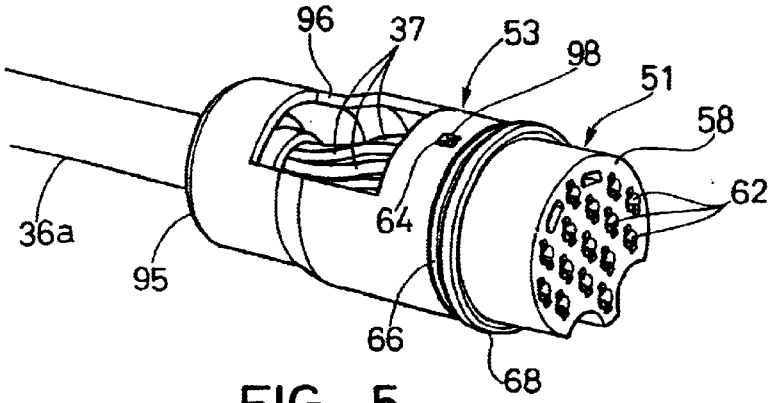
FIG. 5 is a perspective view of the female electrical connector in accordance with the present invention, prior to molding of the outer casing thereon.
Figure 6:
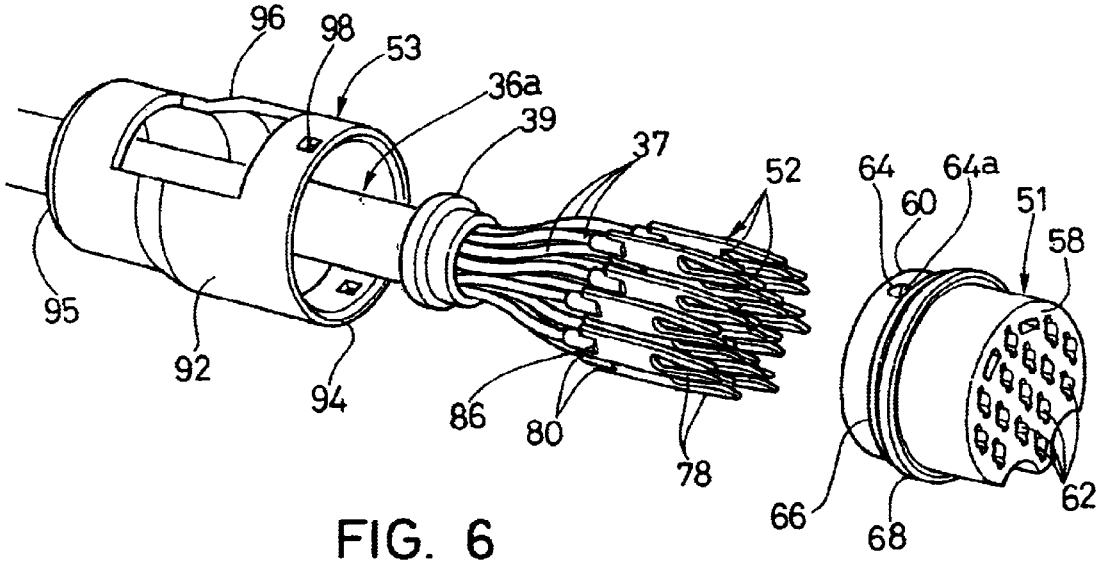
FIG. 6 is a partially exploded perspective view of the female electrical connector in accordance with the present invention as seen in FIGS. 2–3.
Figure 7:
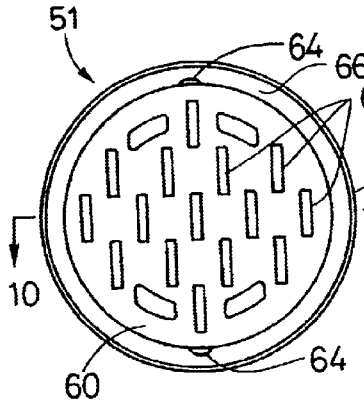
FIG. 7 is a left end elevational view of the terminal housing for the electrical connector illustrated in FIGS. 2–6 in accordance with the present invention.
Figure 8:
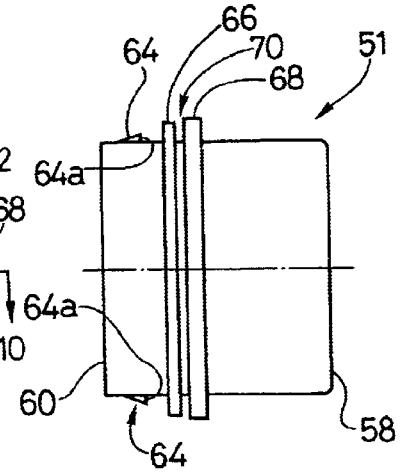
FIG. 8 is a side elevational view of the terminal housing illustrated in FIG. 7 for the electrical connector illustrated in FIGS. 2–6 in accordance with the present invention.

In the illustrated embodiment, the electrical connectors 14 mate with the mating male electrical connectors 15 that are coupled to the shift control unit 32 and the junction box 34, as seen in FIGS. 1C, 2 and 3. The male electrical connector 15 is relatively conventional, and therefore, it will not be discussed and/or illustrated in detail herein. Basically, the male electrical connector 15 has a receptor housing 46 with fifteen receptor pins 48. The receptor pins 48 have a circular cross-section, and are arranged in a pattern to mate with the electrical connector 14, as discussed below. The receptor housing 46 preferably has an annular flange 49 for releasably retaining the electrical connector 14 thereto via a snap-fit. The receptor housing 46 is constructed of a non-conductive material, such as a hard, rigid plastic material. The receptor pins 48 are constructed of a conductive material.

While the electrical connector 14 is especially useful in outdoor applications such as on bicycles, it will be apparent to those skilled in the art from this disclosure that the electrical connector 14 can be used in other applications without departing from the scope of the invention as defined in the appended claims. In the illustrated embodiment, the electrical connector 14 is electrically coupled to each end of the electrical cord 36*a* that is connected to the mating electrical connectors 15 of the shift control unit 32 and the junction box 34.

The electrical cord 36*a* has a plurality of electrical conductors 37 with one end of the electrical conductors 37 fixedly coupled to the terminal pins 52 to form an electrical connection therebetween. In the illustrated embodiment, the electrical cord 36*a* has fifteen electrical conductors 37.

The electrical connector 14 basically has a terminal housing 51, a plurality of terminal pin 52, an inner casing 53, and an outer casing 54. The electrical connector 14 in the illustrated embodiment is a female electrical connector or receptacle. Of course, it will be apparent to those skilled in the art from this disclosure that the electrical connector 14 can be a male electrical connector or a plug without departing from certain aspects of the present invention. However, certain aspects of the present invention are specifically directed to a female electrical connector such as the female electrical connector 14 illustrated in FIGS. 2–6. Also, in the illustrated embodiment, the electrical connector 14 has fifteen terminal pins 52. Of course, it will be apparent to those skilled in the art from this disclosure that the number of terminal pins can be fewer or more depending upon the particular application of the electrical connector. For example, the electrical connectors 14' are identical to electrical connectors 14, except that electrical connectors 14' have been reduced in diameter and only has six terminal pins. Since the electrical connector 14 has fifteen terminal pins 52, the electrical cord 36*a* is a multi-connector cable having fifteen individually insulated conductors with the exposed ends of the conductors electrically coupled to the terminal pins 52 for creating an electrical connection therewith.

As seen in FIGS. 4 and 7–10, the terminal housing 51 has an insulated body 56 with a first end 58, a second end 60 and a plurality of terminal bores 62 longitudinally extending between the first and second ends 58 and 60. The terminal housing 51 is constructed out of a non-conductive material. For example, the terminal housing 51 is constructed of a hard, rigid plastic material for housing the terminal pins 52. Preferably, terminal housing 51 is molded as a one-piece, unitary member constructed of a substantially hard, rigid non-metallic material such as nylon. Preferably, the terminal housing 51 has a plurality of terminal bores 62 with one of the terminal pins 52 being frictionally retained or press-fitted within each one of the terminal bores 62 of the terminal housing 51.

Figure 9:
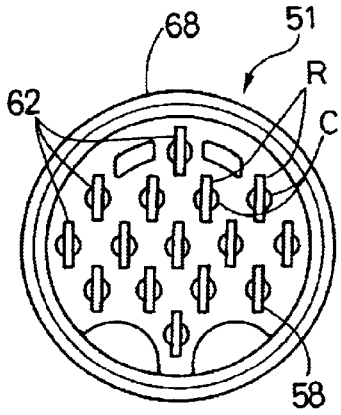
FIG. 9 is a right end elevational view of the terminal housing illustrated in FIGS. 7 and 8 of the electrical connector illustrated in FIGS. 2–6 in accordance with the present invention.
Figure 10:
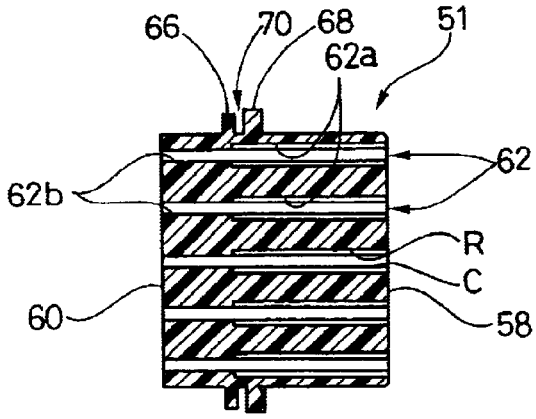
FIG. 10 is a longitudinal cross-sectional view of the terminal housing illustrated in FIGS. 7–9 as seen along section line 10—10 of FIG. 7.
Figure 14:
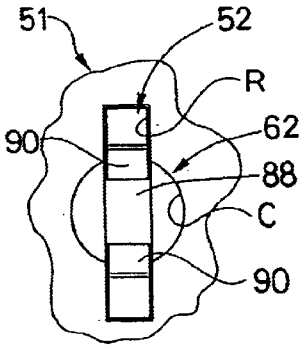
FIG. 14 is a partial end elevational view of one of the terminal bores of the terminal housing illustrated in FIGS. 7–10 with one of the terminal pins retained therein.
Figure 15:
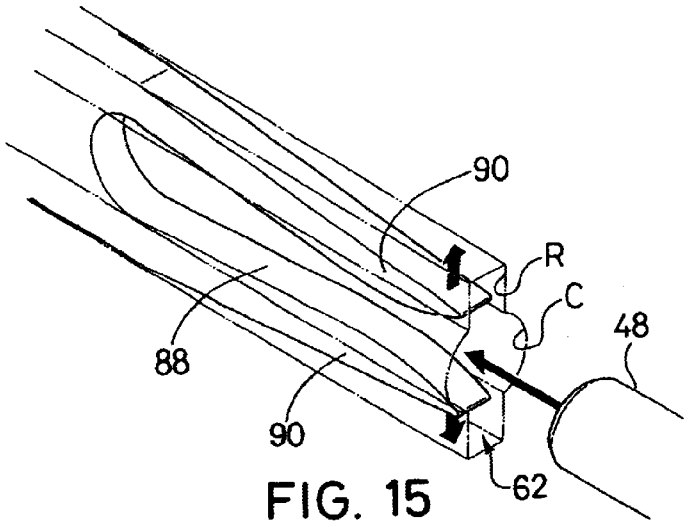
FIG. 15 is a diagrammatic perspective view of one of the terminal bores of the terminal housing and one of the terminal pins that are about to receive a receptor pin of the male electrical connector.
Figure 16:
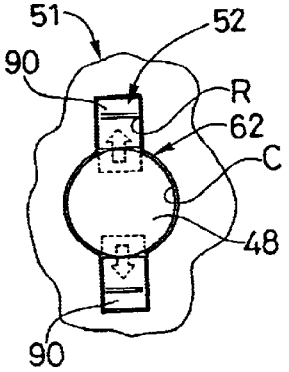
FIG. 16 is a partial end elevational view of one of the terminal bores of the terminal housing with the terminal pin located therein and electrically coupled to the receptor pin of the male electrical connector.
Figure 17:
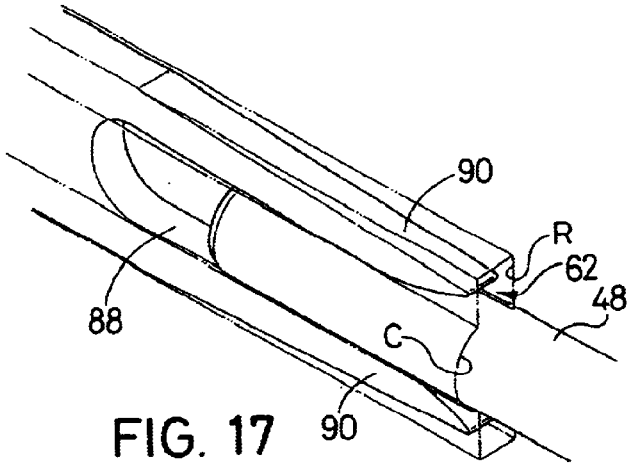
FIG. 17 is a diagrammatic perspective view of the terminal bore and the terminal pin engaged with a receptor pin of the male electrical connector.
Figure 18:
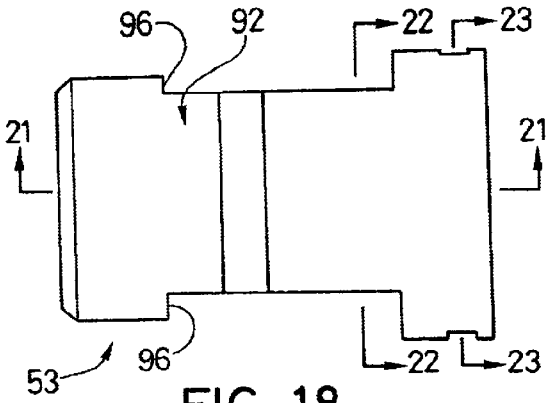
FIG. 18 is a side elevational view of the inner casing for the electrical connector illustrated in FIGS. 2–6 in accordance with the present invention.
Figure 19:
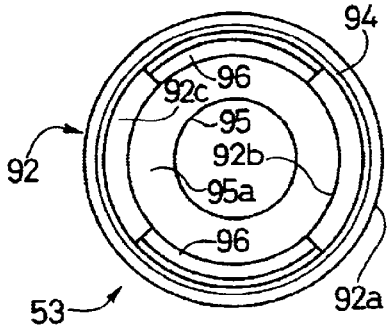
FIG. 19 is a right end elevational view of the inner casing illustrated in FIG. 18 for the electrical connector illustrated in FIGS. 2–6 in accordance with the present invention.
Figure 20:
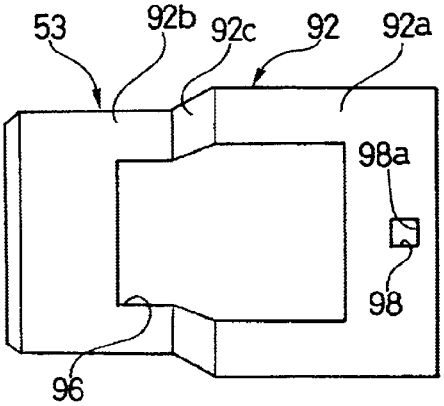
FIG. 20 is a top plan view of the inner casing illustrated in FIGS. 18 and 19 for the electrical connector illustrated in FIGS. 2–6.
Figure 21:
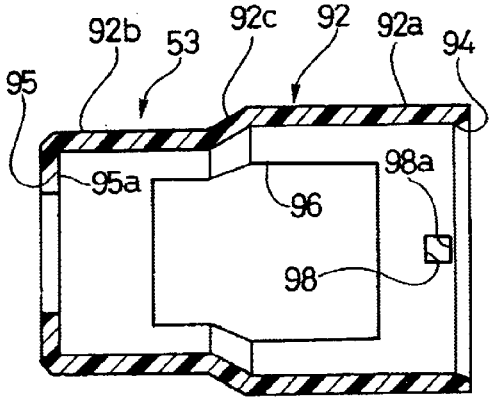
FIG. 21 is a longitudinal cross-sectional view of the inner casing illustrated in FIGS. 18–20 as seen along section line 21—21 of FIG. 18.
Figure 22:
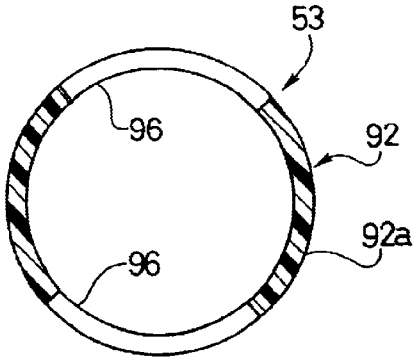
FIG. 22 is a transverse cross-sectional view of the inner casing illustrated in FIGS. 18–21 as seen along section line 22—22 of FIG. 18.
Figure 23:
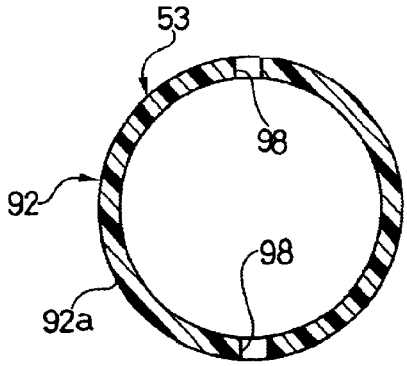
FIG. 23 is a transverse cross-sectional view of the inner casing illustrated in FIGS. 18–22 as seen along section line 23—23 of FIG. 18.

As seen in FIG. 10, each terminal bore 62 has a first bore section 62*a* and a second bore section 62*b*. The first bore section 62*a* has a cross-section formed by an intersection of a rectangle or a rectangular portion R and a circle or circular portion C as best seen in FIGS. 9, 14 and 16. The second bore section 62*b* has a cross-section formed only by the rectangle R. The rectangular portion R is dimensioned to correspond with the cross-section of the terminal pins 52 for frictionally retaining the terminal pins 52 therein. The circular portion C is the size of the receptor pin 48 of the mating male electrical connector 15. Thus, the circular portion C has a diameter that is larger than the width of the rectangular portion R such that the circular portion C extends outwardly from a pair of sides of the rectangular portion K. The circular portion C of the cross-section of the first bore section 62*a* acts as a centering device to ensure good electrical contact between the receptor pins 48 and the terminal pins 52. More specifically, the circular portion C is centered within the rectangular portion R as best seen in FIGS. 14–17.

Preferably, the terminal housing 51 has a generally cylindrical shape with a pair of protrusions or detents 64 formed adjacent the second end 60 and a pair of annular flanges 66 and 68 that form an annular recess 70 therebetween. As discussed below, the protrusions or detents 64 and flange 66 form part of a snap-fit that couples the terminal housing 51 to the inner casing 53. The detents 64 are preferably diametrically opposed, i.e., spaced 180° apart along the outer surface of the terminal housing 51. The annular flange 68 and annular recess 70 are designed to ensure that outer casing 54 is securely molded onto terminal housing 51, as explained below in more detail.

Figure 11:
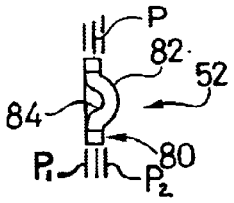
FIG. 11 is a left end elevational view of one of the terminal pins for the electrical connector illustrated in FIGS. 2–6 in accordance with the present invention.
Figure 12:
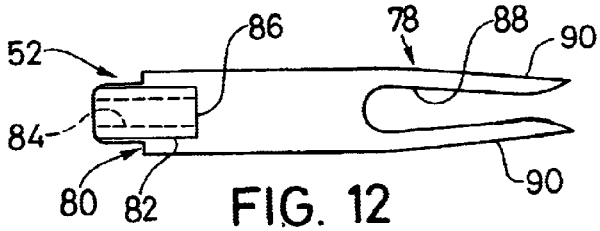
FIG. 12 is a side elevational view of the terminal pin illustrated in FIG. 11 for the electrical connector illustrated in FIGS. 2–6 in accordance with the present invention.
Figure 13:
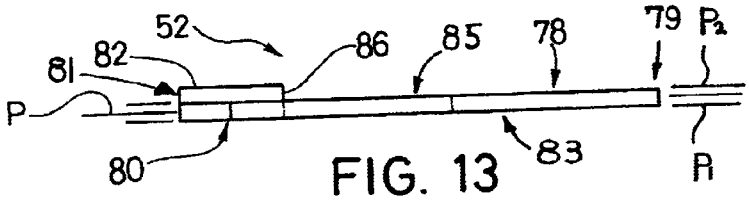
FIG. 13 is a bottom edge elevational view of the terminal pin illustrated in FIGS. 11 and 12 for the electrical connector illustrated in FIGS. 2–6 in accordance with the present invention.

Referring now to FIGS. 11–13, the terminal pin 52 is preferably constructed of any conductive material that is normally utilized in the electrical connector art. Preferably, the terminal pins 52 are each formed from a sheet metal material that is stamped to form the shape as seen in FIGS. 11–13. Each terminal pin 52 has a first contact end 78 with a free end 79 and a second connection end 80 with a free end 81 and a bent portion 82. A cord receiving recess 84 is formed by the bent position 82 and is located on a first longitudinal side of the second connection end 80 such that the cord receiving recess 84 lies within a main plane P of the second connection end 80. As best shown in FIG. 12, the cord receiving recess 84 extends to the free end 81 of the second connection end 80. Also, FIG. 13 shows that the first contact end 78 has first and second substantially planar portions 83 and 85 that define first and second planes $P_1$ and $P_2$, respectively. Moreover, FIG. 11 shows that the first longitudinal side of the second connection end 80 is located substantially between the first and second planes $P_1$ and $P_2$.

The cord receiving recess 84 is designed to receive a portion of the end of one of the electrical connectors 37 of the electrical control cord 36*a*. Preferably, the electrical conductor 37 is soldered within the cord receiving recess 84 to form a secure connection therebetween. The bent portion 82 also forms a stop 86 on a second longitudinal side of the connection end portion 80. The stop 86 is designed to limit axial movement of the terminal pin 52 within the terminal bore 62.

More specifically, when the terminal pin 52 is inserted into one of the terminal bores 62 of the terminal housing 51 from the second end 60, the stop 86 contacts the second end 60 of the terminal housing to limit the axial or longitudinal movement of the terminal pin 52 within the terminal bore 62. Once the terminal pin 52 is fully inserted into the terminal bore 62, the contact end 78 has a receptor pin slot 88 that is located in the first bore section 62*a* of the terminal bore 62.

The receptor pin slot 88 of each terminal pin 52 is centered within the first bore section 62*a* so that the circular portion C ensures a good electrical connection between the receptor pin 48 and the terminal pin 52. The receptor pin slot 88 is basically formed by a pair of tines 90 that diverge towards each other as they approach the free end of the contact end 78 of the terminal pin 52. Accordingly, as seen in FIGS. 14–17, when the receptor pin 48 is inserted into the circular portion C of the first bore section 62*a* of the terminal bore 62, the tines 90 are biased or resiliently deflected radially outwardly from the circular portion C to the rectangular portion R to ensure a good electrical connection therebetween.

Referring now to FIGS. 18–23, the inner casing 53 has a tubular side wall 92 with the terminal housing 51 located in a first open end 94 of the tubular side wall 92 and the electrical conductors 37 located in a second open end 95 of the tubular side wall 92. The tubular side wall 92 has at least one side opening, preferably two side openings 96. The two side openings 96 are preferably diametrically opposed 180° apart. These side openings 96 are relatively large and extend at least approximately half of the longitudinal length of the inner casing 53 in the area of the electrical connections between the electrical conductors 37 and the terminal pins 52. These side openings 96 are designed to allow the material of the outer casing 54 to freely flow into the interior of the inner casing 53 so as to completely cover the ends of the electrical conductors 37 and the connection ends 80 of the terminal pins 52. This ensures a good waterproof connection therebetween. Moreover, by completely encasing the electrical connections between the electrical conductors 37 and the terminal pins 52, the electrical connections are very durable and less resistant to detachment due to vibrations.

The tubular side wall 92 is also preferably provided with a pair of notches 98 which are formed as rectangular openings. These notches 98 form a part of a snap-fit arrangement between the terminal housing 51 and the inner casing 53. The notches 98 are diametrically opposed from each other, i.e., spaced 180° apart around the inner casing 53. The inner casing 53 is constructed from a relatively rigid material with a limited amount of resiliency. In other words, due to the tubular shape of the inner casing 53, the tubular side wall 92 can flex radially outwardly upon the insertion of the terminal housing 51 being inserted into the first open end 94 of the inner casing 53. Insertion of the terminal housing 51 into the first open end 94 causes the protrusions or detents 64 of the terminal housing 51 to engage the inner surface of the tubular side wall 92 of the inner casing 53. The protrusion 64 causes the tubular side wall 92 to flex slightly outwardly until the protrusions 64 engage the notches 98. Preferably, the protrusions 64 are substantially ramp-shaped members with abutment surfaces 64*a* facing in a longitudinal direction towards the first end 58 of the terminal housing 51. The notches 98 have a mating abutment surface 98*a* that faces in an axial direction towards the second open end 94 of the inner casing 53. When the abutment surfaces 64*a* and 98*a* contact each other, relative axial movement of the terminal housing 51 away from the inner casing 53 is prevented. Moreover, the annular flange 66 of the terminal housing 51 abuts the first open end 94 to prevent further inward axial movement of the terminal housing 51 relative to the inner casing 53.

In the preferred embodiment, the tubular side wall 92 has a large cylindrical section 92*a* for receiving the terminal housing 51 and a smaller cylindrical section 92*b* for receiving the electrical control cord 36*a* therein. A frustoconical transition portion 93*c* extends between the large cylindrical section 92*a* and the smaller cylindrical section 92*b* to provide for a smooth transition therebetween. The second open end 95 preferably has a smaller diameter than the first open end 94 due to the inwardly extending abutment flange 95*a*. The abutment flange 95*a* is designed to engage a retaining ring 39 that is located on the end of the electrical cord 36*a* .

Referring again to FIGS. 2–4, the outer casing 54 is molded over an end portion of the electrical cord 36*a*, the portion of the terminal housing 51 adjacent the second end 60, and the tubular side wall 92 of the inner casing 53. The outer casing 54 also extends into the side openings 96 of the tubular side wall 92 of the inner casing 53. The outer casing 54 is a non-conductive material such as a plastic or elastomeric material.

During the molding process, the material of the outer casing 54 is molded over the entire inner casing 53, as well as portions of the electrical control cord 36*a* and the terminal housing 51. Accordingly, the interface between the terminal housing 51 and the first open end 94 of the inner casing 53 is sealed to prevent contaminants from entering therebetween. Moreover, the material of the outer casing covers both annular flanges 66 and 68 and extends into the annular recess 70 to ensure a watertight seal. These side openings 96 are designed to allow the material of the outer casing 54 to freely flow into the interior of the inner casing 53 so as to completely cover the ends of the electrical conductors 37 and the connection ends 80 of the terminal pins 52. This ensures a good waterproof connection therebetween. Moreover, by completely encasing the electrical connections between the electrical conductors 37 and the terminal pins 52, the electrical connections are very durable and less resistant to detachment due to vibrations.

The outer casing 54 is preferably spaced from the exterior surface of the terminal housing 51 between the annular flange 68 and the first end 58 of the terminal housing 51. Thus, an annular space 100 is formed between terminal housing 51 and outer casing 54 for receiving a portion of the male connector 15 therein. Preferably, the outer casing 54 has an annular abutment flange 102 located at its open end for mating with the corresponding annular flange 49 of the male connector 15. Preferably, the material of the outer casing 54 is constructed of a resilient material so that the annular flange 49 of the male connector 15 can expand the outer casing 54 radially outwardly so as to pass beneath the annular flange 102 of the outer casing 54.

The terms of degree such as "substantially", "about" and "approximately" as used herein mean a reasonable amount of deviation of the modified term such that the end result is not significantly changed. These terms should be construed as including a deviation of at least ±5% of the modified term if this deviation would not negate the meaning of the word it modifies.

While only selected embodiments have been chosen to illustrate the present invention, it will be apparent to those skilled in the art from this disclosure that various changes and modifications can be made herein without departing from the scope of the invention as defined in the appended claims. Furthermore, the foregoing description of the embodiments according to the present invention are provided for illustration only, and not for the purpose of limiting the invention as defined by the appended claims and their equivalents.

What is claimed is:

1. An electrical terminal housing comprising:

an insulated body including a first end with a first end surface facing in a first axial direction, a second end with a second end surface facing in a second axial direction that is opposite to said first axial direction, and a terminal bore extending longitudinally between said first and second end surfaces to form a first opening in said first end surface and a second opening in said second end surface, said terminal bore having a first bore section and a second bore section, said first bore section extending from said first end surface so that said first opening and said first bore section have a cross-section formed by an intersection of a rectangular portion and a circular portion, said circular portion of said cross-section of said first bore section having a diameter that is larger than a transverse width of said rectangular portion of said cross-section of said first bore section and smaller than a transverse length of said rectangular portion, said circular portion of said cross-section of said first bore section extending outwardly from a pair of sides of said rectangular portion of said cross-section of said first bore section, said second bore section meeting with said first bore section to form an abutment surface that faces in said first axial direction, and said terminal bore having at least a transverse dimension along its entire length that is at least equal to said length of said rectangular portion.

2. An electrical terminal housing according to claim 1, wherein said second bore section has a rectangular cross-section extending from said first bore section to said second end.

3. An electrical terminal housing according to claim 1, wherein said circular portion of said cross-section of said first bore section is located in a central part of said rectangular portion of said cross-section of said first bore section.

4. An electrical terminal housing according to claim 1, wherein said insulated body further includes a plurality of said terminal bores that extend longitudinally between said first and second ends.

5. An electrical terminal pin comprising:

a first contact end having first and second substantially planar portions defining first and second planes with a main plane located midway between said first and second substantially planar portions; and a second connection end having a free end longitudinally spaced from a free end of said first contact end with a center longitudinal axis of said electrical terminal pin extending between said first contact end and said second connection end, said second connection end having first and second longitudinal sides with a bent portion forming a longitudinally extending cord receiving recess on said first longitudinal side of said second connection end, said first longitudinal side of said second connection end being located substantially between said first and second planes, said cord receiving recess having a depth measured perpendicular to said main plane of said first contact end such that said cord receiving recess extends from said first longitudinal side of said second connection end to a location past said main plane of said first contact end, said cord receiving recess being completely open along said first longitudinal side and extending to said free end of said second connection end such that a portion of an electrical wire can be inserted transversely into said cord receiving recess relative to said main plane of said first contact end.

6. An electrical terminal pin according to claim 5, wherein said first contact end has a receptor pin slot.

7. An electrical terminal pin according to claim 5, wherein said second connection end has a stop formed thereon.

8. An electrical terminal pin according to claim 7, wherein said stop is located on said second longitudinal side of said second connection end that faces in an opposite direction from said first longitudinal side.

9. An electrical terminal pin comprising:

a first end having first and second substantially planar portions defining first and second planes with a main plane located midway between said first and second substantially planar portions; and a second end having a free end longitudinally spaced from a free end of said first end with a center longitudinal axis of said electrical terminal pin extending between said first end and said second end, said second end having first and second longitudinal sides with a bent portion forming a cord receiving recess on said first longitudinal side of said second end, said first longitudinal side of said second end being located substantially between said first and second planes, said cord receiving recess extending to said free end of said second end and having a depth measured perpendicular to said main plane of said first end such that said cord receiving recess extends from said first longitudinal side of said second end to a location past said main plane of said first end, said first and second ends being constructed as a one-piece, unitary member from a conductive sheet material with a predetermined non-deformed thickness.

10. An electrical terminal pin according to claim 9, wherein said depth of said cord receiving recess is substantially equal to said predetermined non-deformed thickness of said sheet material.

11. An electrical connector comprising:

a terminal housing having a first end and a second end with at least one terminal bore longitudinally extending between said first and second ends;

at least one terminal pin being retained within said bore of said terminal housing;

an electrical cord having at least one electrical conductor fixedly coupled to said terminal pin to form an electrical connection therebetween;

an inner casing having a tubular side wall with said terminal housing located in a first open end of said tubular side wall and said electrical conductor located in a second open end of said tubular side wall, said tubular side wall having at least one side opening extending completely through said tubular side wall; and an outer casing molded over a first portion of said electrical cord, said tubular side wall of said inner casing and said second end of said terminal housing, said outer casing extending into and through said side opening of said tubular side wall of said inner casing to contact a second portion of said electrical cord located within said inner casing.

12. An electrical connector according to claim 11, wherein said terminal housing further includes a plurality of said terminal bores that extend longitudinally between said first and second ends with a plurality of said terminal pins located therein.

13. An electrical connector comprising:

a terminal housing having a first end and a second end with at least one terminal bore longitudinally extending between said first and second ends;

at least one terminal pin being retained within said bore of said terminal housing;

an electrical cord having at least one electrical conductor fixedly coupled to said terminal pin to form an electrical connection therebetween;

an inner casing having a tubular side wall with said terminal housing located in a first open end of said tubular side wall and said electrical conductor located in a second open end of said tubular side wall, said tubular side wall having at least one side opening extending completely through said tubular side wall; and an outer casing molded over a portion of said electrical cord, said tubular side wall of said inner casing and said second end of said terminal housing, said outer casing extending into and through said side opening of said tubular side wall of said inner casing, said inner casing is coupled to said terminal housing by a snap-fit.

14. An electrical connector according to claim 13, wherein said snap-fit is formed by one of said inner casing and said terminal housing having a pair of diametrically opposed notches, and the other of said inner casing and said terminal housing having a pair of diametrically opposed protrusions.

15. An electrical connector according to claim 14, wherein said diametrically opposed notches are formed on said inner casing and said diametrically opposed protrusions are formed on said terminal housing.

16. An electrical connector according to claim 15, wherein said diametrically opposed notches are openings.

17. An electrical connector according to claim 11, wherein said terminal bore having a first bore section with a cross-section formed by an intersection of a rectangular portion and a circular portion, said first bore section extending from said first end of said terminal housing, said circular portion of said cross-section of said first bore section having a diameter that is larger than a width of said rectangular portion of said cross-section of said first bore section such that said circular portion of said cross-section of said first bore section extends outwardly from a pair of sides of said rectangular portion of said cross-section of said first bore section.

18. An electrical connector according to claim 17, wherein said terminal bore further includes a second bore section with a rectangular cross-section extending from said first bore section to said second end of said terminal housing.

19. An electrical connector according to claim 17, wherein said circular portion of said cross-section of said first bore section is located in a central part of said rectangular portion of said cross-section of said first bore section.

20. An electrical connector according to claim 11, wherein said inner casing has a pair of said side openings.

21. An electrical connector according to claim 20, wherein said side openings are diametrically arranged.

22. An electrical connector according to claim 21, wherein said side openings extend at least one-half of a longitudinal length of said tubular side wall between said first and second open ends.

23. An electrical connector according to claim 22, wherein each of said side openings has a circumferential length with a total of said circumferential lengths of said side openings extending approximately one-half of a circumferential length of said tubular side wall.

24. An electrical connector according to claim 21, wherein each of said side openings has a circumferential length with a total of said circumferential lengths of said side openings extending approximately one-half of a circumferential length of said tubular side wall.

25. An electrical connector comprising:

a terminal housing having a first end and a second end with at least one terminal bore longitudinally extending between said first and second ends;

at least one terminal pin being retained within said bore of said terminal housing;

an electrical cord having at least one electrical conductor fixedly coupled to said terminal pin to form an electrical connection therebetween;

an inner casing having a tubular side wall with said terminal housing located in a first open end of said tubular side wall and said electrical conductor located in a second open end of said tubular side wall, said tubular side wall having at least one side opening; and an outer casing molded over a portion of said electrical cord, said tubular side wall of said inner casing and said second end of said terminal housing, said outer casing extending into said side opening of said tubular side wall of said inner casing, said terminal pin includes a first contact end, and a second connection end longitudinally spaced from said first contact end to form a center longitudinal axis between said first contact end and said second connection end, said second connection end having a bent portion forming a longitudinally extending cord receiving recess located on a first longitudinal side of said second connection end, said cord receiving recess lying adjacent to said center longitudinal axis of said second end and being completely open along said first longitudinal side such that a portion of a wire can be inserted transversely into said cord receiving recess relative to said center longitudinal axis.

26. An electrical connector according to claim 25, wherein said second connection end has a stop formed thereon.

27. An electrical connector according to claim 26, wherein said stop is located on a second longitudinal side of said second connection end that faces in an opposite direction from said first longitudinal side.

28. An electrical connector according to claim 25, wherein said first contact end has a receptor pin slot.

29. An electrical connector according to claim 25, wherein said first contact end and said second connection end are constructed as a one-piece, unitary member from a conductive sheet material with a predetermined non-deformed thickness.

30. An electrical connector according to claim 29, wherein said cord receiving recess has a depth that is substantially equal to said predetermined non-deformed thickness of said sheet material.

* * * * *